US006176365B1

(12) United States Patent
Klemm

(10) Patent No.: US 6,176,365 B1
(45) Date of Patent: Jan. 23, 2001

(54) TRANSFER SYSTEM FOR A TIMED VEHICLE TRANSPORT

(75) Inventor: Peter Klemm, Stuttgart (DE)

(73) Assignee: Schuler Pressen GmbH & Co., Goeppingen (DE)

( * ) Notice: Under 35 U.S.C. 154(b), the term of this patent shall be extended for 0 days.

(21) Appl. No.: 08/993,090

(22) Filed: Dec. 18, 1997

(30) Foreign Application Priority Data

Dec. 18, 1996 (DE) ..... 196 52 709

(51) Int. Cl.[7] ..... B65G 25/00

(52) U.S. Cl. ..... 198/621.1; 198/464.4; 414/750; 72/405.16

(58) Field of Search ..... 198/621.1, 621.2, 198/468.2, 464.4; 414/750; 901/49; 72/405.16, 405.13, 405.12

(56) References Cited

U.S. PATENT DOCUMENTS

| | | | | |
|---|---|---|---|---|
| 4,187,942 | * | 2/1980 | Ward | 414/750 |
| 4,252,229 | * | 2/1981 | Corbett | 414/750 |
| 4,513,602 | * | 4/1985 | Sofy | 414/750 |
| 4,540,087 | * | 9/1985 | Mizumoto | 72/405.16 |
| 4,627,253 | * | 12/1986 | Tennessen et al. | 72/405.16 |
| 4,875,931 | * | 10/1989 | Monteiro | 414/750 |
| 4,969,349 | * | 11/1990 | Maher | 414/750 |
| 5,105,647 | * | 4/1992 | Maher | 72/405.16 |
| 5,140,839 | * | 8/1992 | Bruns | 198/468.4 |
| 5,737,960 | * | 4/1998 | Brandstetter et al. | 72/405.16 |
| 5,934,125 | * | 8/1999 | Takayama | 72/405.16 |
| 5,970,763 | * | 10/1999 | Takayama | 72/405.16 |

FOREIGN PATENT DOCUMENTS

| | | | |
|---|---|---|---|
| 44 22 719 A1 | | 1/1996 | (DE) . |
| 195 06 079 A1 | | 8/1996 | (DE) . |
| 58605 | * | 1/1983 | (JP) ..... 198/626.1 |
| WO 97/28913 | | 8/1997 | (WO) . |

* cited by examiner

*Primary Examiner*—Christopher P. Ellis
*Assistant Examiner*—Joe Dillon, Jr.
(74) *Attorney, Agent, or Firm*—Evenson, McKeown, Edwards & Lenahan, P.L.L.C.

(57) ABSTRACT

A control device for electric direct drives of a transfer system contains at least one monitoring device which, in the case of the malfunctioning of a direct drive, switches the control device into an emergency operating mode. In the emergency operating mode, the control device disconnects the linear drive affected by the malfunction from power and controls the remaining direct drives preferably at full power or at a slightly higher power. Thereby, a freedom from collision is established between the forming tool and the transfer device, after which the press is preferably stopped.

4 Claims, 7 Drawing Sheets

TRANSFER SYSTEM FOR A TIMED VEHICLE TRANSPORT

BACKGROUND AND SUMMARY OF THE INVENTION

This application claims the priority of German application 196 52 709.0, the disclosure of which is expressly incorporated by reference herein.

The present invention relates to a transfer system and, more particularly, to a system for transporting workpieces along press stations and the like having at least one transfer rail whose longitudinal course coincides essentially with a direction into to which the workpieces are to be transported in a timed manner and which is provided with devices for receiving and holding the workpieces, having several electric drives whose outputs are connected with the transfer rail and which drive the transfer rail with a coinciding power direction so that the electric direct drives form a driving unit for a predetermined axial direction, having a control device which controls the electric direct drives pertaining to the driving unit essentially in a coinciding manner and which takes up an emergency operating mode in the case of danger caused by the failure of a direct drive or parts of the control device assigned to it.

Particularly multistation presses, such as vehicle body presses or the like, have transfer systems for transporting workpieces from station to station. For this purpose, such transfer systems usually have two mutually parallel transfer rails between which mutually spaced cross traverses are held which have holding devices, such as suction spiders or the like. The workpiece transport takes place by a combined lifting, advancing and lowering movement of the transfer rails, i.e two-axis transfer.

Furthermore, transfer systems are known in which, instead of the cross traverses, holding devices are provided which are held on the transfer rails. In addition to the lifting, lowering and advancing movement, the cross traverses also carry out a transverse movement, i.e. three-axis transfer, with a vertical movement for the lifting/lowering, a longitudinal movement for carrying out a transfer step, and a transverse movement for the opening and closing.

A three-axis transfer is known in which linear motors are provided as drives for the movements in the three moving axes. The linear motors are controlled separately, in which the linear motors of one transport rail are controlled synchronously with the linear motors of the other transport rail as well as synchronously with the press.

While the direct drive of transfer drives by using linear motors results in low-cost, constructionally simple transfer systems, which permit a flexible application, in the event of a failure of individual system components, there is the danger that the transfer rail and/or other elements of the transfer system, such as cross traverses, do not carry out the desired movement and, for example, do not leave the work station in time after the receiving and depositing of a workpiece. In the case of multistation presses, this may lead to serious damage to the transfer rail or other elements and, in the worst case, to the entire transfer system and/or the tools.

DE 44 22 719 A1 describes a safety device for a flexible transfer system for presses, in which the transfer rail of a three-axis transfer is disposed on a prestressed spring-loaded device. This spring-loaded device is locked in the inoperative condition in its tensioned position and, when it is triggered, generates a fast lateral movement of the transfer rail. For the locking of the spring-loaded device, a toggle lever system is triggered electromagnetically in the event of a defect. The now occurring fast transverse movement of the transfer rail leads this transfer rail out of the danger zone.

For a single transfer rail, several spring-loaded devices are as a rule required which, overall, result in significant expenditures and in a considerable additional mass which must be accelerated and braked during the transfer.

It is an object of the present invention to provide a fail-safe transfer system which has good dynamics.

This object has been achieved in accordance with the present invention by a transfer system in which in the emergency operating mode, the control device 36 essentially disconnects the direct drive of the drive unit from power which is affected by the failure, and in that, in the emergency operating mode, the control device continues to control the remaining direct drives and moves the transfer rail and its holding devices out of the work stations.

The transfer system according to the invention, which may be constructed as a two-axis or three-axis transfer, has at least one, preferably two mutually parallel transfer rails which are operated in at least one axial direction, e.g., in the "opening/closing" direction, that is, toward one another and away from one another, by means of electric direct drives. Thereby, the respective transfer rail is driven in the transverse direction by several electric direct drives which act in parallel and which are applied to the transfer rail by means of their respective output. The direct drives are spaced away from one another and are distributed along the length of the transfer rail. For example, three or more direct drives are provided for each axis.

The control device provided for the control synchronously controls the direct drives pertaining to one axis in a coinciding manner so that so that the transfer rails carry out the predetermined movement over their entire length in a uniform manner. The control device preferably receives sensor signals, for example, concerning the actual position of the transfer rail, so that a position control can be achieved.

In addition to its regular operating mode, in which it causes the transfer rail(s) to move at a predetermined timing along a preferably programmable or otherwise adjustable transfer curve, the control device has an emergency operating mode in which it disconnects at least one of the connected direct drives, which are to be operated synchronously, from power or essentially from power. Such an error may, for example, occur when a position sensor assigned to the corresponding linear drive emits an invalid signal. When this is recognized, the assigned direct drive is disconnected from power very rapidly. As a result, the assigned direct drive is prevented from operating against the other direct drives and block or hinder the movement of the transfer rail. In the event of the failure of a single drive, the sequence of movements can be continued until a secure condition is reached.

The communication system (bus, star, ring) between the central control and the intelligent drives is configured such that, in the event of the failure of an individual drive, it will continue to remain operative. However, the control device will continue to control the remaining direct drives in the emergency operating mode so that the movement of the transfer rail will at least be continued until the holding devices are guided out of the work stations. Because of the fast power disconnecting of the direct drive affected by the damage, this can take place by means of the remaining linear motors at a sufficient speed, these being desired for this purpose.

In particular, when the transfer rail is moved in one axis by several, preferably more than three direct drives, the performance reduction in the case of the failure and after the power disconnection of a direct drive will be low so that the transfer rail can be moved out of the danger zone. Optionally, the direct drives can also be operated for a short time at a higher power in the emergency operating mode. In particular, this can take place when the operation of the transfer system is not continued for several cycles but only until the transfer rails and/or the holding devices are in a safe position.

The direct drives assigned to one axis preferably have a uniform capacity. Thereby, in the event of a failure of any direct drive, the emergency operation will in each case result in tolerable conditions. The capacity of the direct drives is preferably dimensioned such that, in the event of a failure of one direct drive, they will still supply the full required total power or at least sufficient power.

The transfer rail of the transfer system according to the invention is preferably constructed to be particularly resistant to bending in order to ensure that, also in the event of a failure of one direct drive, no elastic bending will occur which could lead to a collision between the transfer rail and the tool. For this purpose, the resistance to bending, for example, in the lateral direction is increased. Consequently, the natural frequency of a supporting rail section which extends from an operating direct drive by way of a defective direct drive to the next operative direct drive is higher than the lowest excitation frequency which results from the lateral movement in the emergency operating mode.

In the emergency operating mode, the movement of the transfer rail may deviate from the movement curve which the transfer rail travels during the regular operation. In particular, the movement curve during the emergency operation may be defined such that a fastest possible leaving of the work stations is permitted. Under certain circumstances, this may be achieved by a pure lateral movement of the transfer rail. As a rule, however, also during the emergency operation the curve travelled in the regular operation is attempted to be followed at least within a predetermined tolerance.

Direct drives are preferably electric linear motors; however, hydraulic or other electrically controllable direct drives can also be used within the scope of the present invention.

For sensing failures on sensors, the direct drives or the control device, a monitoring device can be provided for recognizing defect conditions. The monitoring device can be part of the control device or can be constructed separately therefrom. In the event of a failure in the system, the monitoring device determines the direct drive which can no longer be controlled correctly and initiates the emergency operating mode by way of the remaining direct drives.

A further increase of the operating safety is achieved by the use of a redundant communication system between the central control and the intelligent drives. The fail-safety is further increased by the redundant construction of the central control.

The control device preferably contains separate control units which are each assigned to a direct drive. The control units which are subordinate to a central unit communicate with one another and with the central unit by way of a data transmitting system which may have a ring structure or a bus structure. For avoiding dependent failures of larger system parts, failed transmission sections may be switched inactive. In addition, the entire system or parts thereof can be constructed to be redundant in that stand-by units are provided which take over the operation in the event of a failure.

The advantages of the transfer system as well as advantageous embodiments are also correspondingly achieved for a multistation press which is equipped with such a transfer system.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
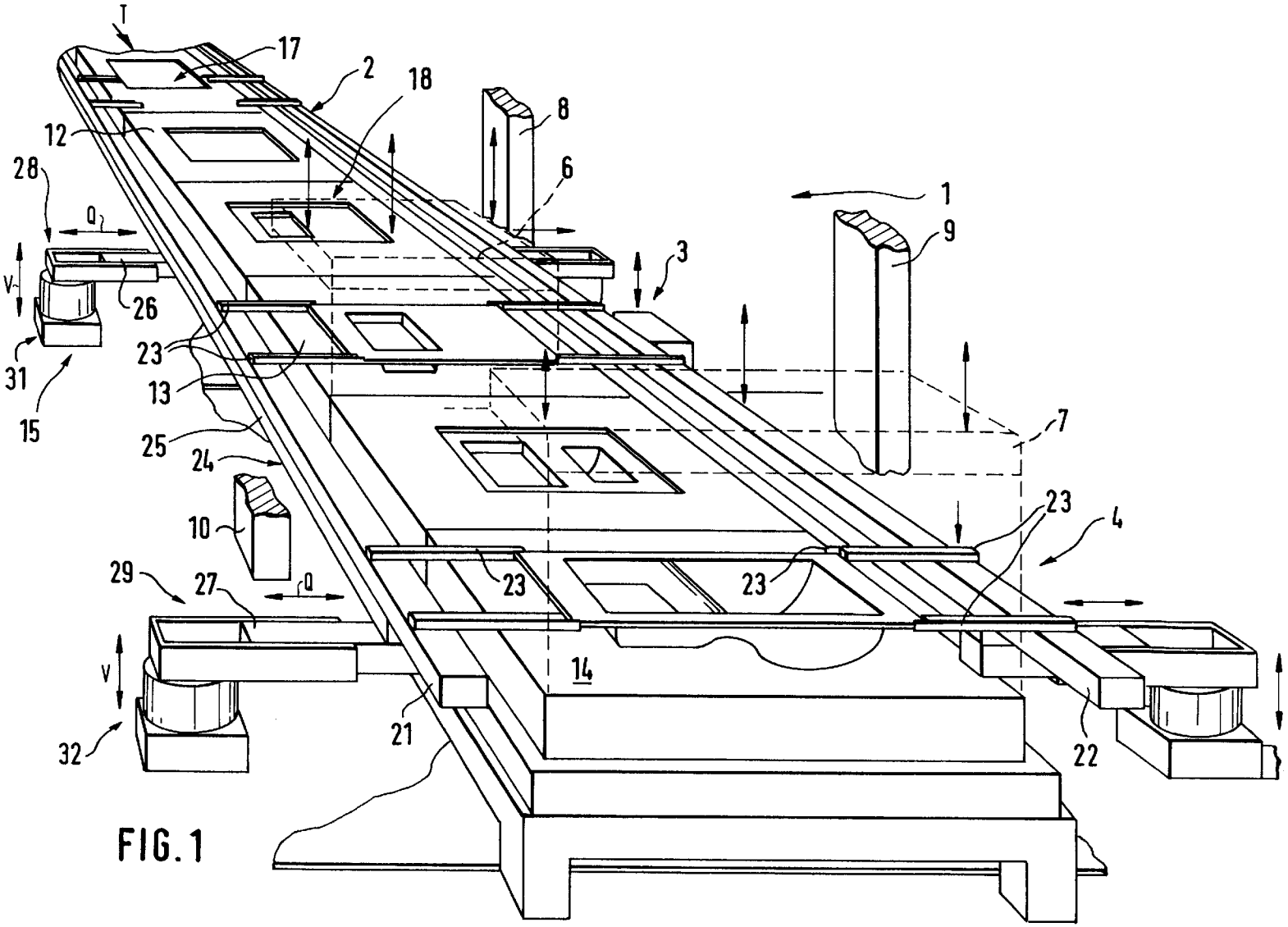
FIG. 1 is a schematic perspective representation of a multistation press with a three-axis transfer, in which the slide guides and the slide drives are omitted.

FIG. 1 schematically illustrates a multistation press 1 which has several press stations 2, 3, 4 arranged behind one another in the passage direction T as well as additional press stations. For improving clarity and ease of understanding, slides 6, 7 assigned to the work stations 3, 4 are indicated only by dash lines, and for the purpose of simplification, the slide guides, slide drives and press frame having been omitted. The press frame is indicated only by stands 8, 9, which are sectionally illustrated as examples.

A three-axis transfer system 15 is used for transporting workpieces from press station to press station wherein tools are arranged. The workpiece transport takes place optionally by way of intermediate depositing devices 17, 18, 19 arranged between the press stations 2, 3, 4.

The transfer device 15 has two mutually parallel transfer rails 21, 22 which extend along the passage direction T and carry holding devices 23 for receiving and depositing workpieces. The transfer rails 21, 22, with respect to a vertical longitudinal center plane of the multistation press 1, including its drives, are constructed mirror-symmetrically with respect to one another. The following description of the transfer rails 21 therefore applies as well to the transfer rail 22.

The transfer rail 21 is movably disposed in the passage direction T as well as in the vertical direction V and in the direction of the center of the multistation press 1 and away therefrom, i.e. in the transverse direction Q. A longitudinal carriage guide is used for bearing and guiding the transfer rail 21 in the longitudinal direction (timing direction T). This longitudinal carriage guide is formed by a longitudinal carrier 25 on which the transfer rail 21 is disposed in a longitudinally displaceable manner.

For driving the transfer rail 21 in the longitudinal direction, electric linear motors constructed as direct drives are used and act between the longitudinal carrier 25 and the transfer rail 21. Several linear motors can be distributed along the length of the longitudinal carrier 25. In principle, controlled or regulated hydraulic drives can also be used instead. For the position control, position-sensing sensors are provided which emit a signal characterizing the relative position of the transfer rail 21 with respect to the longitudinal carrier 25.

The longitudinal carrier 25 is supported by several cross carriages 26, 27, which are spaced away from one another in the longitudinal direction and which form the output of linear motors 28, 29 for the transverse direction Q. The linear motors 28, 29 are provided with sensors which emit a position signal.

Figure 2:
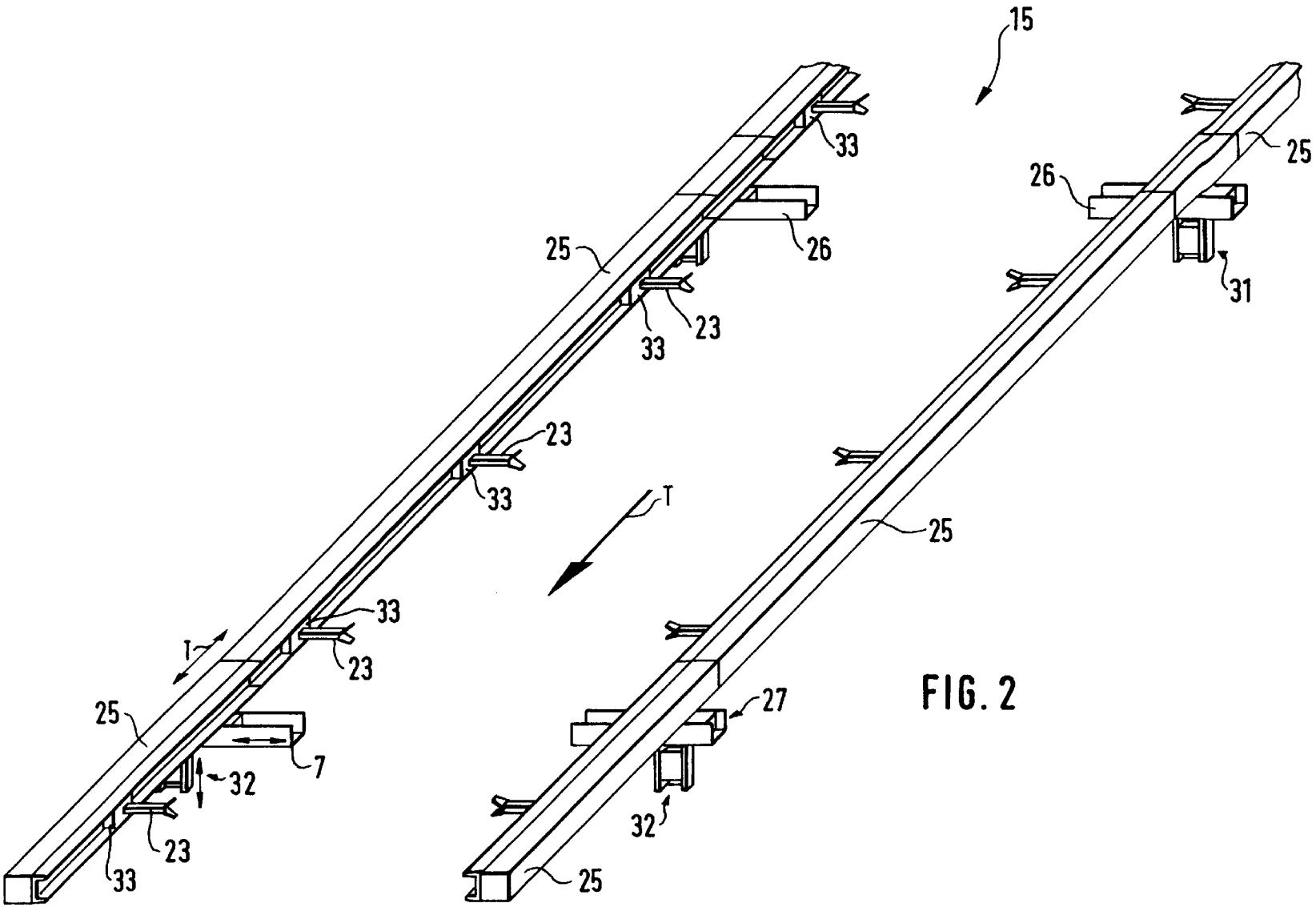
FIG. 2 is a schematic perspective view of the three-axis transfer of FIG. 1 with linear motors used as the direct drive.

For lifting and lowering the transfer rail 21, the linear motors 28, 29 are in each case held on lifting units 31, 32 which may also be operated by electric linear motors or other direct drives. For a clearer representation, the transfer system 15 is illustrated separately in FIG. 2, and deviates from the above-described transfer system in that no continuous transfer rail is disposed in a longitudinally displaceable manner on the longitudinal carrier 25 divided here several times but individual carriage units 33 which are each driven directly by way of a separate linear drive. Each carriage unit 33 carries a holding device 23.

Figure 3:
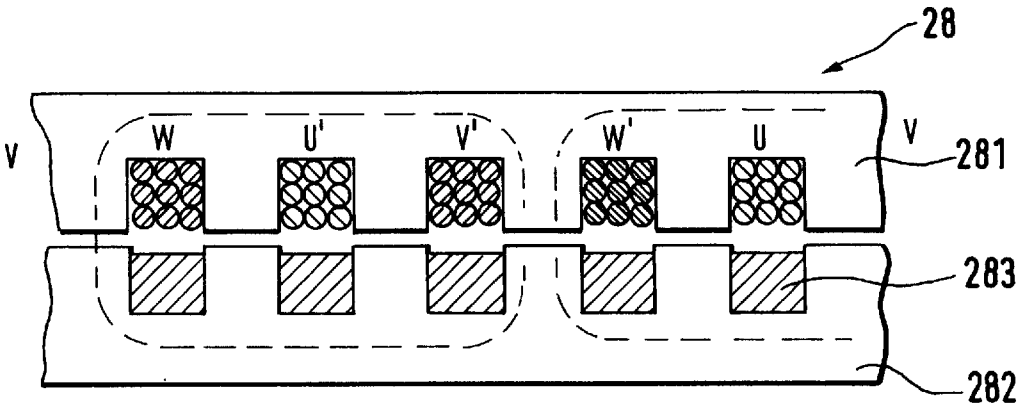
FIG. 3 is a schematic sectional view of an asynchronous linear motor which can be used as a direct drive for the three-axis transfer of FIG. 2.

FIG. 3 illustrates the linear motor 28. It has a primary part 281 serving as an output and a secondary part 282 which is constructed as a stator and which contains short-circuit conductors 283 in corresponding grooves of the ferromagnetic stator. Windings which are embedded in grooves of the ferromagnetic primary part 281 are controlled in a phase-shifted manner (U, V, W; U', V', W'). As required, instead of an individual line motor, a double-line motor, a solenoid motor or a synchronous motor with a permanent-magnetic excitation can be used. The asynchronous motor is preferred because it can be disconnected from power in a particularly simple manner.

Figure 4:
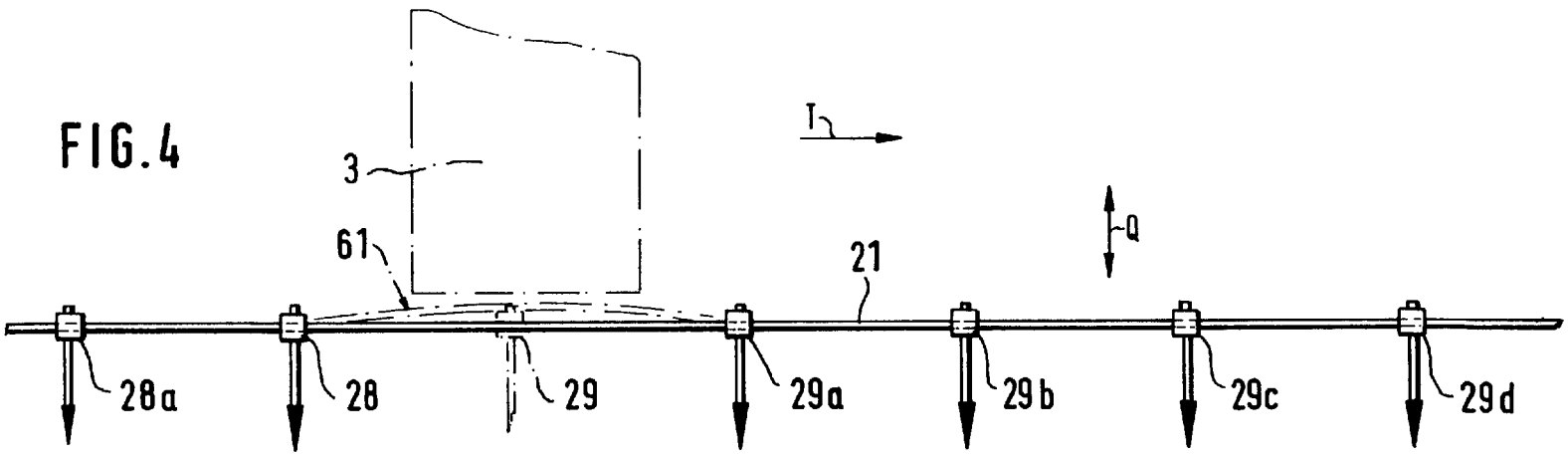
FIG. 4 is a top view of a transfer rail of the three-axis transfer with a failed linear drive, with an exaggerated representation of possible dynamic transition operations.
Figure 5:
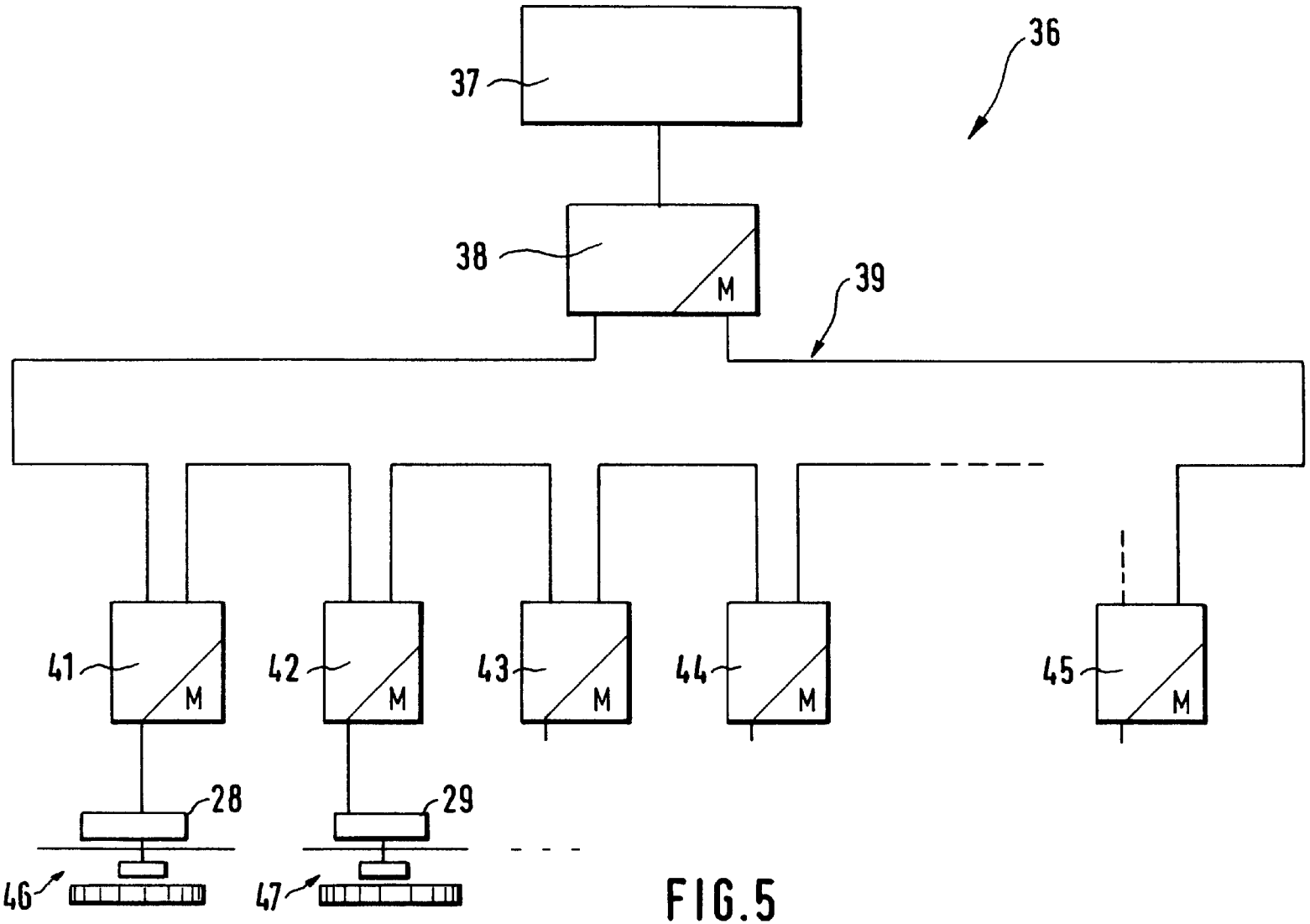
FIG. 5 is a block diagram of a control device which controls the linear motors and has several control units according to the present invention.

As illustrated in FIG. 4, in addition to the mentioned linear motors 28, 29, other linear motors 28*a*, 29*a*, 29*b*, 29*c*, 29*d*, which are controlled synchronously, are applied to the transfer rail 21, for example, for the movement in the transverse direction Q (opening and closing). For this purpose, a control device 36 is used which is illustrated, for example, in FIG. 5 and which is subordinate to a press control 37. The control device 36 has a central unit 38 to which, by way of an optical wave guide ring circuit 39, control units 41, 42, 43, 44 and 45 are connected as well as other control units. The optical wave guide ring circuit 39 is used for the data exchange between the central unit 38 and the control units 41 to 45. Each control unit 41 to 45 controls an electric linear motor 28, 29, which for reporting the position, is in each case provided with a linear path measuring unit 46, 47.

One monitoring unit M respectively is constructed on the control units 41 to 45 and/or on the central unit 38 and monitors the correct function of the respective unit, of the connected linear drive 28, 29 as well as connected sensors 46, 47. The monitoring unit M may also be part of the control units 41 to 45 or of the central unit 38. For example, the monitoring function can be carried out by the control unit or by a program section which is part of a program of the control unit or central unit 41 to 35, 38.

In the case of a proper functioning of the sensing system of the linear motors of the current supply as well as of the control units 41 to 45 and of the central unit 38, the monitoring units M do not influence the operation of the control device 36. The control units 41 to 45 receive control signals for the positioning of the transfer rail 21 by way of the optical wave guide ring circuit 39 from the central unit 38. The control units 41 to 45 convert these control commands and control the respective connected linear motors such that the predetermined movement is achieved.

Figure 6:
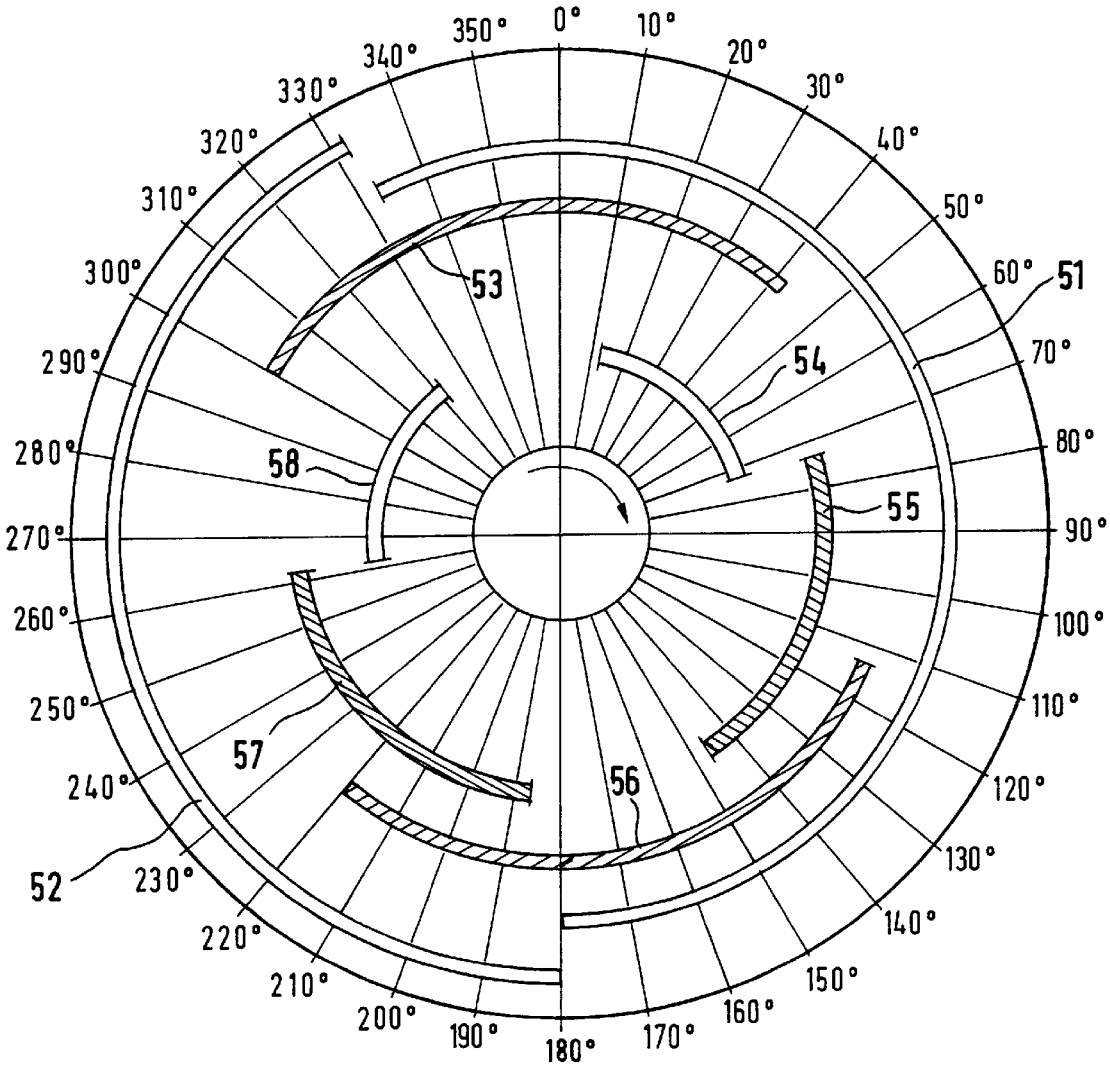
FIG. 6 is a polar diagram for illustrating the time-related or phase-related assignment of movements of the three-axis transfer with respect to a press rotation.
Figure 6A:
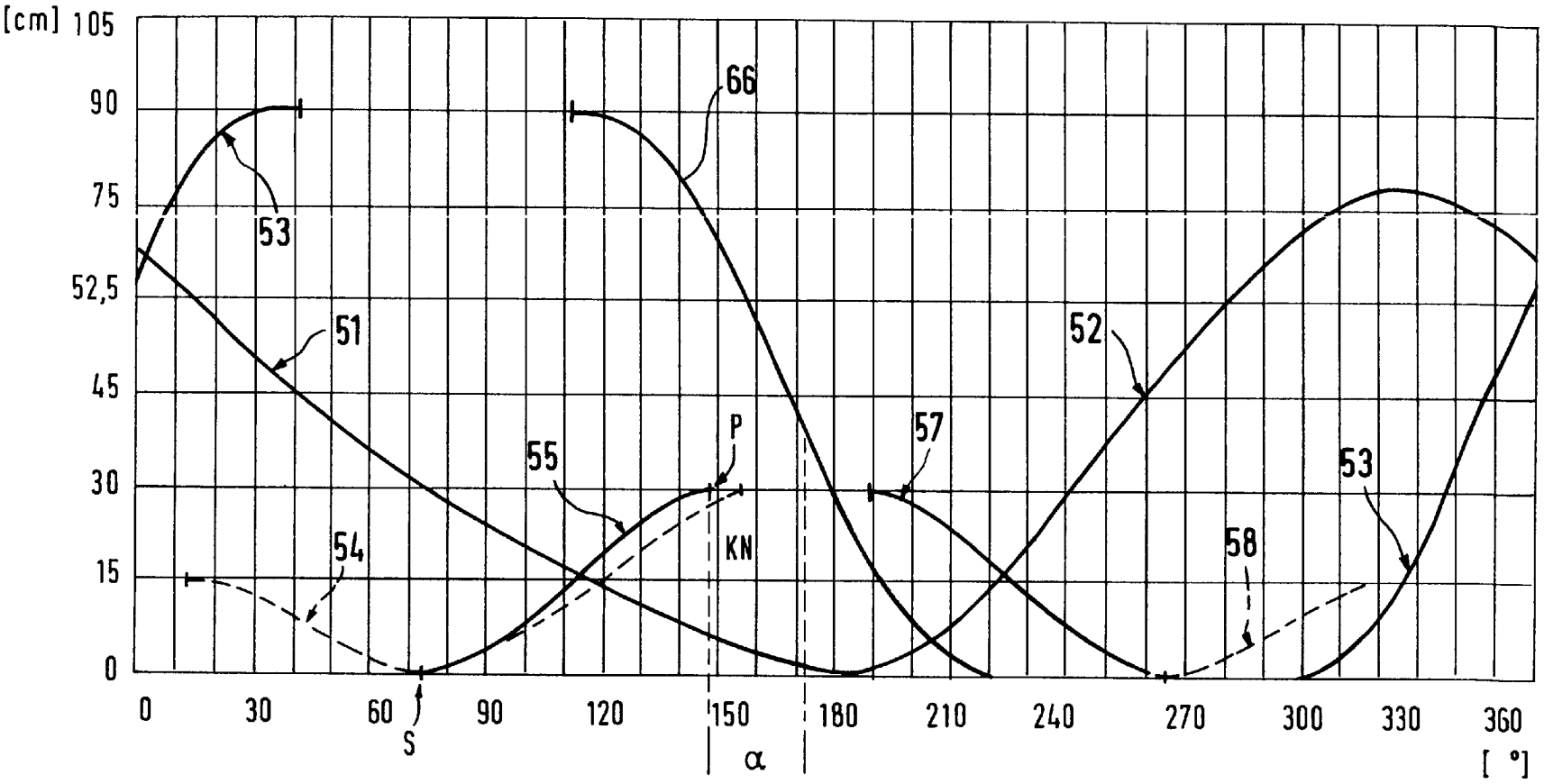
FIG. 6A is a view of time sequences of the movement of the transfer rails and of the press slide.

Relative to a press rotation, FIGS. 6 and 6A illustrate angle areas in which the transfer system 15 must have carried out predetermined movements as well as their time sequences. An angle area 51 taking up more than half of an eccentric shaft rotation characterizes the downward stroke of the press slide, for example, in a drawing stage, or in another press stage. The remaining angle area 52 characterizes the return stroke of the slide. The control of the linear drives is synchronized with this movement. In an angle area 53, the transfer rails 21, 22 carry out a return stroke which guides a workpiece into the open tool. Before the end of the feeding stroke, the transfer rails 21, 22 start their lowering in the angle area 54. As soon as at "S" the workpiece is deposited on the bottom tool, the transfer rails 21, 22 start to move away from one another in the angle area 55 in order to expose the closing tool. While the punch is moved further downward, the return stroke 66 of the transfer rails 21 22 starts still during their opening movement (angle area 55), in the case of an angle position of approximately 110°. During the return stroke movement 66 of the transfer rails 21, 22, these transfer rails 21, 22, when the tool opens up, start to close again in an angle area 57 in order to grip the workpiece and, with the die open, lift the die in the area 58 and transport it into the angle area 53 in the next cycle.

The angle area 55 is particularly critical in which the opening transfer rails must have left the working range of the slide while the tool closes. If this is not achieved, because of the relatively large centrifugal masses contained in the drive, the press slide cannot stop abruptly so that a collision takes place between the tool and the transfer rails 21, 22 or the holding devices 23.

In order to avoid damage to the tools and to the transfer system 15 in such cases, the monitoring devices M monitor the correct operation of the transfer system 15. If it is determined that, for example, an individual linear motor does not operate correctly or is not controlled correctly so that a collision may occur, the corresponding monitoring device emits an error signal to the concerned control unit and/or to the overall system. Such a triggering error can, for example, be effected a sensor signal from the linear path measuring device 47 which, with respect to the other sensor signals, is outside a predetermined tolerance. In such an embodiment, the control unit 36 changes into an emergency operating mode. Particularly in the angle area 55, this mode has the purpose of moving the transfer rails 21, 22 and the connected holding devices 23 out of the closing tool. For this purpose, the linear drive affected by the defect (in the described embodiment, the linear motor 29) is disconnected from power while the other linear motors continue to be operated at full power. The linear motors are dimensioned such that, also when one linear motor fails, the power required for accelerating and braking the transfer rails 21 can be applied by the remaining linear motors.

In the simplest case, a position P of the transfer rails 21, 22 which is secure with respect to the slide movement, that is, does not collide, is adjusted in the emergency operating mode, after which the transfer system 15 and the main press drive are stopped. The secure or collision-free position P can be reached on the movement curve through which the movement otherwise also takes place during the correct operation. The definition of deviating curves KN for the emergency operation is such that a collision-free position P can be reached faster or at a lower power expenditure. The emergency operation provides the significant advantage that only a small safety angle is required between the moving of the holding devices 23 out of the tool and the closing of the tool. As a result, the operating speed of the press can be increased.

As illustrated in FIG. 4, the mutually spaced linear motors 28, 28*a,* 29 and 29*d* form power introduction points which are spaced away from one another. The transfer rail 21 has such a lateral stiffness so that, with occurring, relatively high accelerations in the direction of the Q-axis, it does not significantly bend. In addition, the transfer rail 21 has a stiffness reserve which prevents, in the event of a failure of a linear motor, e.g. linear motor 29, the transfer rail 21 from bending elastically because of the now larger distance between the active linear motors 28 and 29 during the lateral acceleration, as indicated at reference number 61. The increased stiffness of the transfer rail 21 therefore permits, in the event of a failure of a linear motor, the failed motor's driving power to be taken over by the adjacent linear motors 28, 29*a* as well as the other linear motors and to be introduced into the transfer rail 21.

The control device 36 takes up a similar emergency operation when parts of the optical wave guide ring circuit 39 fail which, with a corresponding layout of the information transmitting system, results only in a failure of one or fewer driving units. The linear motors which remain active change into the emergency operation and ensure a collision-free operation during the particularly critical opening phase, i.e. 55 in FIG. 6.

Figure 7:
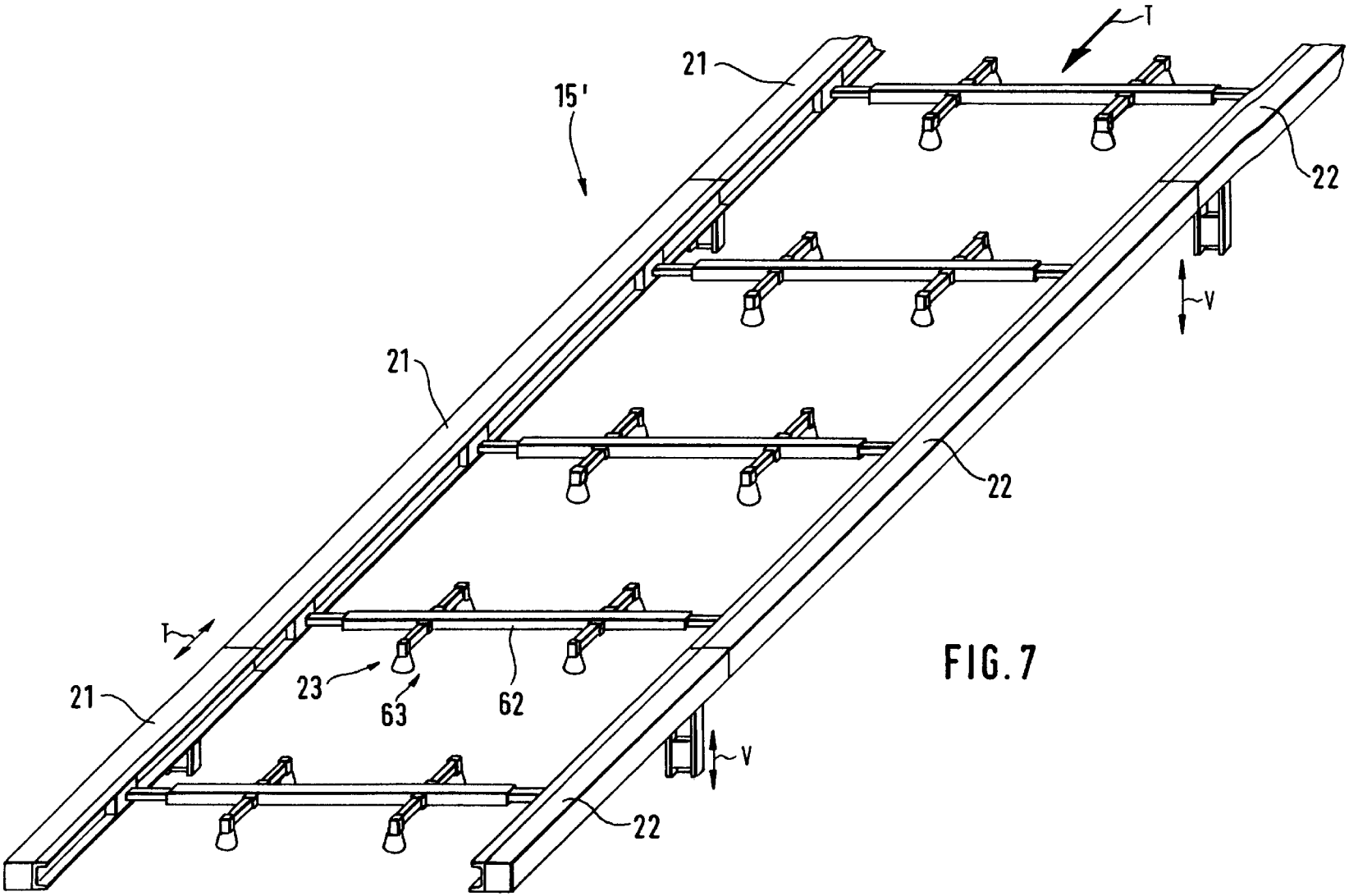
FIG. 7 is a perspective view of a two-axis transfer driven by electric linear motors.

FIG. 7 illustrates a modified transfer system 15' which is constructed as a two-axis transfer in which the transfer rails 21, 22 can be moved only in the passage direction T as well as in the vertical direction V. For the drive in the passage direction T and as a stroke unit for the lifting and lowering in the vertical direction, electric linear drives are used, as illustrated in principle in FIG. 3. Cross traverses 62, which are provided with suction spiders 63, are held between the transfer rails 21, 22. In such a two-axis transfer system 15', it is important that the holding devices 23 (suction spiders 63) be moved, in the event of a fault during the closing of the tool, in time out of the tool. While, with the three-axis transfer, this movement takes place essentially in the direction of the Q-axis, in the two-axis transfer system 15', in the emergency operation by way of the remaining linear drives, a stroke is carried out in the transfer direction into a secure, collision-free position, after which the press is stopped.

A control device 36 for electric direct drives 28, 29 in a transfer system 15 contains at least one monitoring device M which, in the event of a malfunctioning of a direct drive 28, 29, switches the control device 36 into an emergency operating mode. In the emergency operating mode, the control device 36 disconnects the linear drive affected by the defect from power and controls the remaining direct drives preferably at full or at a slightly higher power such that a freedom from collision is established between the forming tool and the transfer system 15, after which the press is preferably stopped.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for switching a transfer system for the workpiece transport along several working stations, including press stations in an emergency operating mode, comprising:

at least one transfer rail having a longitudinal orientation which coincides substantially with a direction into which workpieces are to be transported in a timed manner and having devices operatively associated therewith for receiving and holding the workpieces;

a plurality electric direct drives having outputs connected with and driving the at least one transfer rail with a coinciding force direction such that the electric direct drives form a group of drives for a defined axial direction; and a control device which controls in a substantially coinciding manner the electric direct drives pertaining to the group of drives and which takes up an emergency operating mode in an event caused by breakdown of one of the direct drives or of a portion of the control device associated with the direct drive, wherein in the emergency operating mode, the control device is configured to switch the electric direct drive of the group of drives affected by the breakdown to be substantially unpowered, and in the emergency operating mode, the control device is configured to continue to control unaffected electric direct drives and guide the at least one transfer rail and the associated holding devices out of the working stations.

2. Method according to claim 1, wherein in the emergency operating mode, the electric direct drives are configured to be controlled such that the movement of the transfer rail follows, at least in sections, within a defined tolerance, a variation in time travelled through during normal operation.

3. Method according to claim 1, wherein a monitoring device is configured to monitor signals emitted by at least one of sensors and devices associated with the control device for detecting system faults.

4. Method according to claim 1, wherein the control device is configured to stop the at least one transfer rail as soon as the at least one transfer rail has reached a secure position in the emergency operating mode.

* * * * *